US005320297A

United States Patent [19]

Goerner et al.

[11] Patent Number: 5,320,297

[45] Date of Patent: Jun. 14, 1994

[54] ROLL-WINDING APPARATUS DRIVE MECHANISM

[75] Inventors: Bernd Goerner; Volker Rose, both of Baden-Wurttemberg, Fed. Rep. of Germany

[73] Assignee: Beloit Technologies, Inc., Wilmington, Del.

[21] Appl. No.: 550,244

[22] Filed: Jul. 6, 1990

Related U.S. Application Data

[63] Continuation of Ser. No. 296,559, Jan. 12, 1989, abandoned.

[30] Foreign Application Priority Data

Jan. 13, 1988 [DE] Fed. Rep. of Germany ..... 3800703

[51] Int. Cl.[5] ..... B65H 18/20

[52] U.S. Cl. ..... 242/67.10 R; 242/68.4; 310/67 R

[58] Field of Search ..... 242/67.1 R, 68, 68.1, 242/68.2, 68.4, 78.1; 310/154, 67 R; 901/62, 64; 623/64

[56] References Cited

U.S. PATENT DOCUMENTS

| | | | |
|---|---|---|---|
| 1,994,404 | 3/1935 | Reiners et al. | 242/18 DD |
| 3,097,808 | 7/1963 | Williams | 242/68.2 |
| 3,455,520 | 7/1969 | Beemer | 242/78.1 |
| 3,469,751 | 9/1969 | Tyrner et al. | 242/18 DD |
| 3,710,291 | 1/1973 | Nicoud | 310/154 X |
| 4,023,057 | 5/1977 | Meckling | 310/154 |
| 4,512,529 | 4/1985 | Kampf | 242/67.1 R |
| 4,516,046 | 5/1985 | Mercier | 310/154 |
| 4,766,775 | 8/1988 | Hodge | 901/23 X |
| 4,787,262 | 11/1988 | Kozawa | 901/23 X |
| 4,812,104 | 3/1989 | Suzuki | 901/23 X |
| 4,876,494 | 10/1989 | Daggett et al. | 901/23 X |

FOREIGN PATENT DOCUMENTS

| | | | |
|---|---|---|---|
| 1499664 | 12/1968 | Fed. Rep. of Germany | 242/65 |
| 2835441 | 2/1980 | Fed. Rep. of Germany | 310/154 |

*Primary Examiner*—Daniel P. Stodola
*Assistant Examiner*—Paul T. Bowen
*Attorney, Agent, or Firm*—Dirk J. Veneman; Raymond W. Campbell; Gerald A. Mathews

[57] ABSTRACT

A device for reeling web-like material, in which the roll being formed is held between heads borne on carrier arms, which device reels the roll with a central drive. The drive is provided by direct-current, permanent magnet electric motors maximum power output mounted in the carrier arms, in which motors the stator, is faced with permanent magnets made of samarium cobaltate ($SmCo_5$).

8 Claims, 2 Drawing Sheets

ROLL-WINDING APPARATUS DRIVE MECHANISM

This is a continuation of copending application Ser. No. 07/296,559 filed on Jan. 12, 1989, now abandoned.

BACKGROUND OF THE INVENTION i. Technical Field

This invention pertains generally to the field of roll-winding apparatus, and pertains more particularly to a high torque drive mechanism useful in paper web winders.

ii. Prior Art

Roll-winding devices are used in various industries for winding web-like material. In the paper industry, such devices are commonly used in connection with roll-slitting machines, in which a roll of paper the width of a paper machine is divided into several narrower rolls by unfeeling the paper from the wide supply roll, cutting the paper web longitudinally, and rewinding the resulting individual, narrower webs into narrower rolls. The longitudinally separated strips or narrow webs are passed around one or two winding rollers, and are individually attached to winding tubes or cores, the lengths of which correspond to the width of the individual strips concerned. The ends of the winding tubes are held in clamping heads, which are located at the upper ends of carrier arms. The clamping heads are driven, and rotate the winding tubes to form the individual narrower rolls from the narrow strips supplied thereto. The narrow rolls can be reeled in such a way that, as they are being wound, the rolls are pressed against the winding rollers with adjustable compressive force; or the rolls can be reeled freely, i.e., leaving an interval or space between the winding roller and the roll being wound.

As the diameter of the forming roll increases, the carrier arms, the lower ends of which are pivotably mounted on horizontal axes parallel to the winding axis, move away from the winding rollers.

From both theory and practice in the reeling of rolls, it is known that, in order to achieve a well-reeled structure, it is necessary to have the greatest possible center moment. This is especially true for rolls which are large in both diameter and width, i.e., heavy rolls; and for rolls which are formed by so-called free reeling, in which the width of material can be applied over only one central moment per winding station.

The use of hydraulic drives on the carrier arms to rotate the rolls being wound is known. Hydraulic drives provide adequate performance for rolls of certain dimensions. Nevertheless, hydraulic drives are not favored for use in paper winding applications, since there is practically no such thing as a leakproof hydraulic system. The danger always exists that the hydraulic oil will find its way onto the paper, which can lead to extensive product rejection.

The use of electric drives for roll winding devices is also known, and has been favored for its clean operation compared to hydraulic drives, particularly for winding smaller rolls, and lighter materials. In order to achieve the required torque necessary for winding larger rolls and heavy materials such as paper, it has heretofore been necessary to use very large electric motors. The motors are mounted on the outsides of the carrier arms, and, due to the motor overhang, the motor precludes the reeling of rolls narrower than about seven-hundred millimeters (700 mm), since the carrier arms of a roll can not be brought any closer together because of the motors. Nevertheless, it is often desirable to reel rolls narrower than seven-hundred millimeters (700 mm).

SUMMARY OF THE INVENTION

A principle object of the present invention is to provided a drive mechanism for a roll-winding apparatus utilizing two parallel, laterally-spaced carrier arms, and which provides high torque center drive for winding rolls.

Another object of the present invention is to provide a drive mechanism for roll-winding machines which is compact in size, and which is clean in operation.

These and other objects are achieved in the present invention through the use of a special kind of motor which produces the required torque at a minimal motor cross-sectional dimension, so that the already present cross-sectional dimension of the carrier arm is not exceeded by the motor width.

It has been shown that, when high-performance, permanent magnet motors are used, essential reduction in size can be achieved despite the high torque requirements. Permanent magnet, direct current motors and alternating current motors are, in fact, known. However, such motors have not heretofore been designed for the range of 40–50 kW at 2000 rpm that is required in paper roll winders. The normal rpm range of such motors designed previously has been limited to about 800 rpm.

In order to achieve maximum power output, the use of permanent magnets made of rare earth metals, such as samarium cobaltate ($SmCo_5$), is indicated, since these materials lend themselves to the production of the strongest magnetic fields presently known. However, such materials are very hard, and are difficult to work. Consequently, it is practical that the magnets be of simple geometrical form, and that the pole shoes of the stator be faced with the metals, especially with rectangular-shaped forms. The affixing of the magnets can be accomplished by cementing.

The cross-sectional configuration of the carrier arms described previous for paper web winding usually is either circular, with a diameter in the order of two-hundred millimeters (200 mm), or square, with comparable side lengths. It has been shown that it is possible to fabricate direct-current, permanent magnet motors with the necessary power output with external cross-sectional dimensions in the range of one-hundred fifty to one-hundred eighty millimeters (150–180 mm). Such motors can then be mounted in a carrier arm so as to require no additional space; or, alternatively, the motor can be mounted on the outer side of the carrier arm without the contour of the latter being significantly increased when viewed in a given direction.

Experience has shown that electric motors of the design described can attain a torque of two hundred to two-hundred twenty Newton/meters (200–220 Nm) at two thousand revolutions per minute (2000 rpm). This represents approximately a fourfold increase of the performance level of conventional direct-current motors of the same size.

Additional advantages as to dimension and performance are realized when the carrier arm also serves as the housing for the electric motor or vice versa. The exterior wall then serves simultaneously as the mounting site for the clamping heads and as a functional part of the motor.

An embodiment example of the invention is illustrated schematically in the appended drawings.

DETAILED DESCRIPTION OF THE PREFERRED EMBODIMENT

Figure 1:
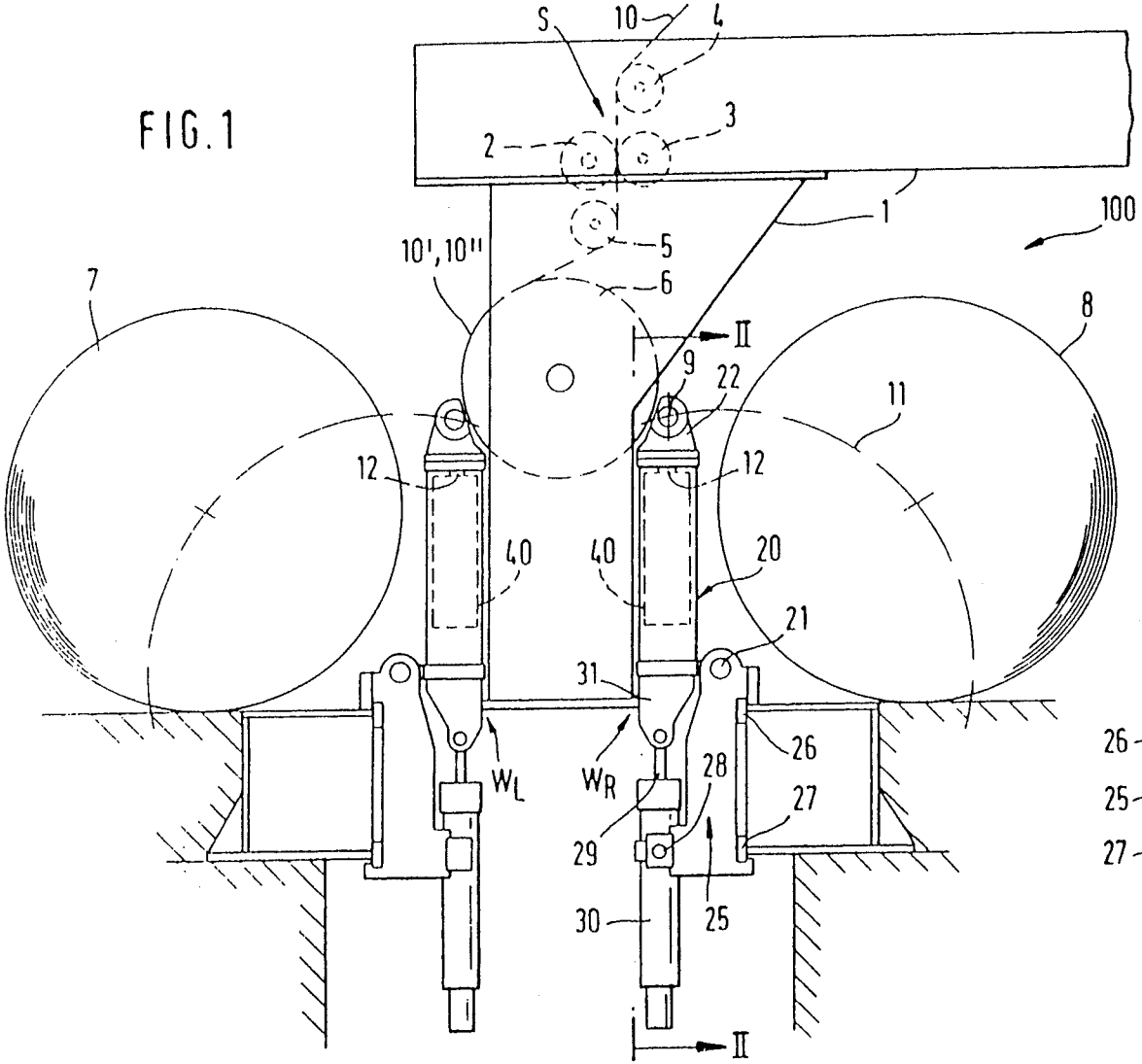
FIG. 1 depicts, in a simplified side elevational view, a roll-winding apparatus having a drive mechanism in keeping with the present invention.

Referring now more specifically to the drawings, and to FIG. 1 in particular, a roll-slitting machine (100) is shown which can be used for the multiple, longitudinal slitting of a paper web (10) which is paper-machine width, and for reeling the resulting strips into narrower rolls (7, 8).

The roll-slitting machine (100) encompasses a portal-like machine frame (1) with a cutting station (S) in its upper section. The cutting station has, for each longitudinal cutting operation, a pair of circular, plate-like cutting blades (2, 3) working in unison, which are arranged horizontally along side each other, and between which the width of paper (10) is passed vertically by means of guide rollers (4, 5). After departing the cutting station, the width of paper (10) consists of the desired number of separated, partial strips (10', 10'') running alongside each other, which are directed around a winding drum (6) located beneath the cutting station (S). The narrow rolls (7, 8) are reeled against the winding drum (6). The winding drum (6) is designed as a vacuum roller, so that, after removal of the finished narrow rolls (7, 8), the ends of the partial widths (10', 10'') can be secured.

The slitting machine (100) thus described can employ a drive mechanism embodying the present invention. It should be understood that winding devices other than that shown can also employ the present invention advantageously.

A reeling device ($W_R$) is described below. The reeling devices ($W_R$) and ($W_L$) are mirror images of each other.

The reeling device ($W_R$) is positioned to the right of the winding drum (6), and incorporates at least two carrier arms (20), which are spaced a certain distance apart in the direction of the axis of the winding drum (6). The carrier arms are pivotably mounted at their lower ends on flushly-aligned swivel trunnions (21). At their upper ends, the carrier arms (20) support flushly-aligned clamping heads (22) which are arranged in pairs that are oppositely directed, and which include oppositely directed clamping trunnions (23). As can be best seen in FIG. 2, the trunnions (23) of a pair fit into the opposite ends of a cardboard or steel winding tube or core (24), onto which the narrow roll (8) is reeled. The swivel trunnion (21) of each carrier arm (20) is mounted in a sliding carriage (25), which is displaceable along guide tracks (26, 27) in the base of and extending the full width of the roll-slitting machine. By means of an unillustrated positioning device, the sliding carriages (25) can be positioned at any selected location across the width of paper (10).

While the swivel trunnion (21) is mounted on the upper end of the sliding carriage (25), the lower end of the carriage bears, via a trunnion (28), a pivotally mounted, hydraulic swivel cylinder (30), the piston rod (29) of which engages with bearing arms (31) at the lower end of the carrier arm (20). Activation of the swivel cylinder (30) can cause the carrier arm (20) to rotate clockwise, as indicated in FIG. 1, while the winding axis (9) represented by the axis of the tension trunnions (23) describes the arc (11) shown in broken outline in FIG. 1.

In the position illustrated in FIG. 1, the carrier arms (20) are at the beginning of a reeling cycle. One carrier arm (20) of a pair of arms of the reeling device ($W_R$) has been appropriately positioned, whereupon the winding tube (24) is placed onto the clamping trunnion (23) thereof, either manually or by a suitable contrivance. By advancing the other carrier arm (20) of the pair, the winding tube is engaged by the other clamping trunnion (23) of the pair.

With the carrier arms (20) in the position shown in FIG. 1, the winding tube (24) is in the immediate vicinity of the winding drum (6). A partial strip (10') is fed around the winding drum (6), and the free end of the strip is glued or otherwise adhered to the winding tube (24). Then, the clamping trunnions are set into rotary motion by a central drive, to initiate the reeling operation.

The narrow roll (8) can be held against the winding drum (6) with a certain compressive force supplied by the swivel cylinder (30), or, alternatively, the narrow roll (8) can be reeled freely. In any case, the drives of the clamping trunnions (9) of the winding drum (6) and of the cutting station (S) are under coordinated control. The drive is slowly accelerated until the full reeling speed is reached. The narrow roll (8) then becomes larger and larger and is ultimately released, as illustrated in FIG. 1, when the desired diameter has been reached.

Figure 2:
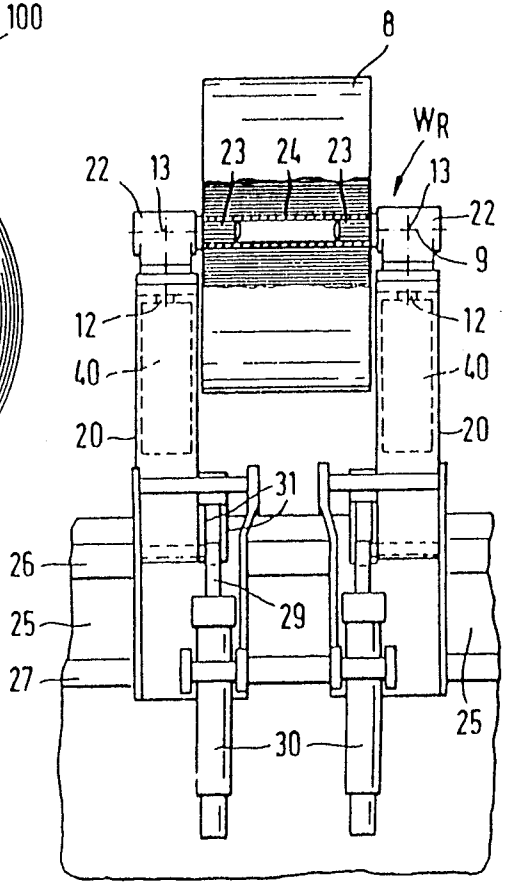
FIG. 2 is a view of the carrier arms holding a narrow roll, the view having been taken generally along line II—II in FIG. 1.

The reeling device ($W_L$) is positioned at the left side of the winding drum (6), and is offset opposite the reeling device ($W_R$). Reeling device ($W_L$) serves to wind the narrow roll (7) from partial strip (10''). The offset of the reeling devices ($W_R$, $W_L$) in the axial direction of the winding drum (6), and the reeling on both sides of the winding drum (6) are conditioned by the fact that, as can be seen in FIG. 2, the carrier arms (20) project beyond the edges of the narrow rolls (7, 8). Due to space limitations, not all of the partial rolls (7, 8) can be reeled on the same reeling axis, rather they must be reeled in alternating sequence in the axial direction on both sides of the winding drum (6). Usually, there are several reeling devices ($W_L$, $W_R$) on each side, in axial alignment.

The drive for trunnions (23) is accomplished by electric motors (40) mounted in each carrier arm, with the axis (13) of the motor, i.e., the motor shaft (12), being in longitudinal alignment with the carrier arm (20). The motors provide power to angular gears indicated only schematically in FIG. 2.

The electric motors are direct-current, permanent magnet motors of a special design, which, despite their cross-sectional dimension of for example, fifteen to eighteen centimeters (15–18 cm), fulfill the high torque requirements for acceleration and reeling of heavy paper rolls with diameters as great as fifteen-hundred millimeters (1500 mm). The diameters of the electric motors (40) is so minimal that the motor readily can be installed inside the carrier arms (20), so that the carrier arms (20) can serve as the housing for the electric motors (40). Outward projection of the motor with respect to the carrier arms is nonexistent, so that the motor in no way obstructs the positioning of the sliding carriages (25).

Figure 3:
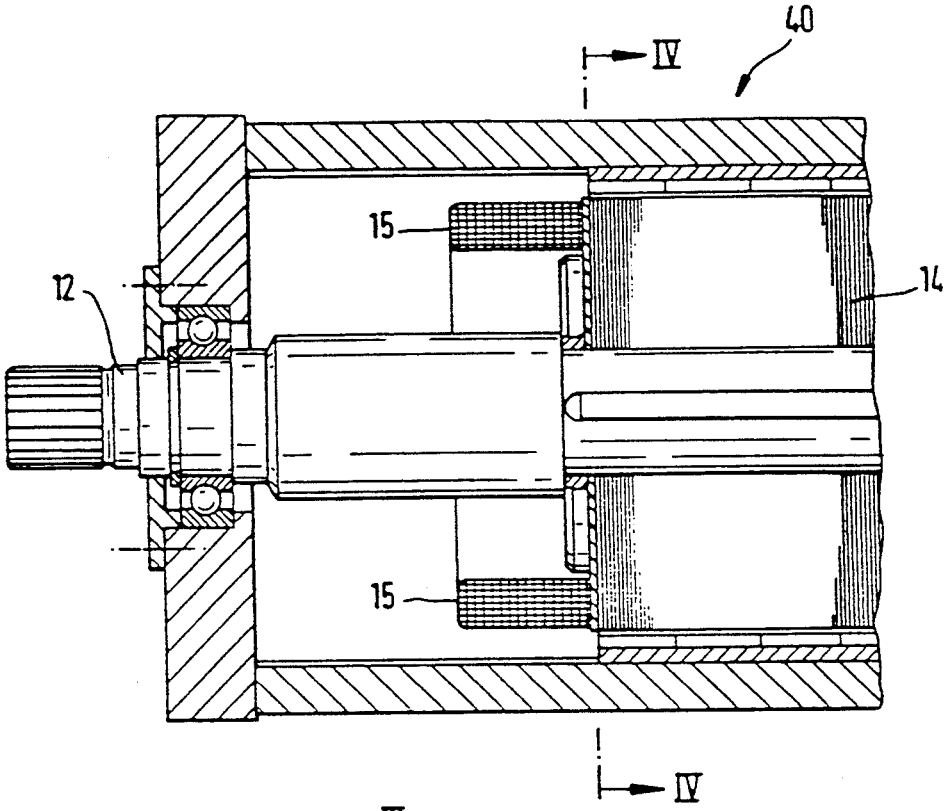
FIG. 3 is a schematic, longitudinal cross-section taken along line III—III of FIG. 4 through the end of a motor for use in keeping with the present invention.
Figure 4:
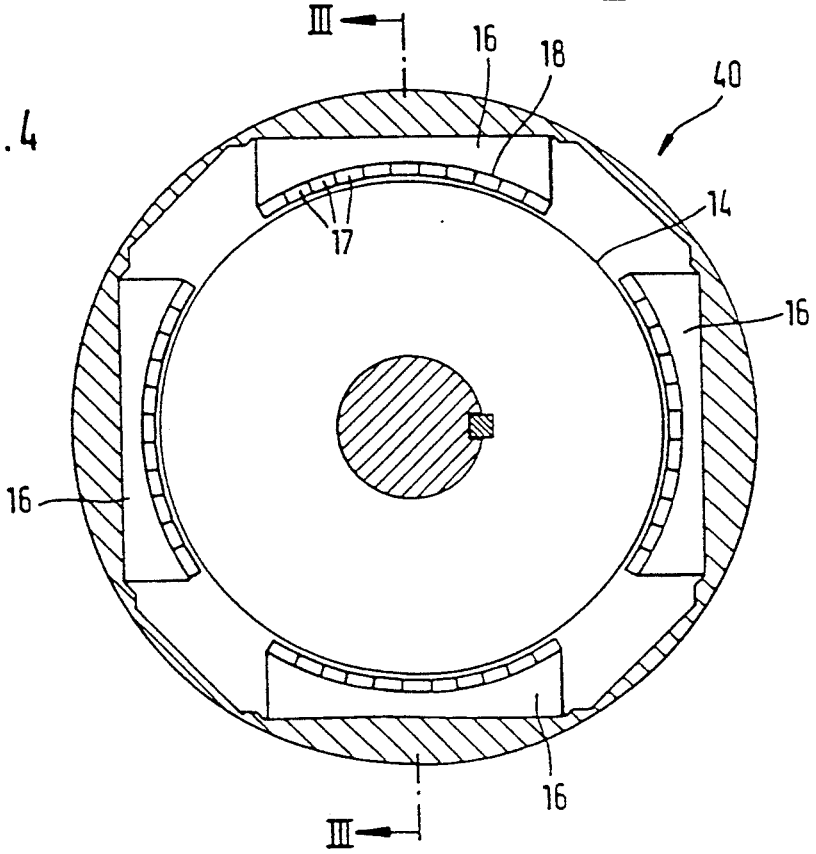
FIG. 4 is a schematic cross-section view taken along line IV—IV in FIG. 3.

The construction of the electric motors (40) is shown schematically in FIGS. 3 and 4. Mounted on the motor shaft (12) is an armature (14) of conventional design, consisting of laminated sheets with armature windings (15). The armature windings have been omitted from FIG. 4, in which the entire armature is represented by a simple circle also depicted by (14). The design of the pole shoes (16) is significant, the shoes being faced on their entire surface facing the armature (14) with rectangular-shaped pieces (17) of samarium cobaltate ($SmCo_5$). Samarium cobaltate is a permanent-magnet material of the highest quality, although it is very difficult to work. Simple forms, such as the brick-like rectangular form shown, can be produced at less cost than more complex forms. The concave surface (18) of the pole shoe (16) is uniformly covered with glued-on shaped pieces (17) of samarium cobaltate, while the longitudinal orientation of these shaped pieces is in the axial direction. As may be clearly seen in FIG. 4, the width of the individual-shaped pieces (17) is so minimal that the resulting lining agrees quite well with the outer periphery of the armature (14). In the case of the embodiment example, the length of the shaped pieces (17) of the magnetic material is about twenty millimeters (20 mm), the width about eight millimeters (8 mm).

By virtue of this construction of the electric motor (40), with a power output of forty to fifty kilowatts (40–50 kw) at two-thousand revolutions per minute (2000 rpm), a torque of two hundred to two-hundred twenty Newton/meters (200–220 Nm) can be provided despite the minimal external dimension of the electric motor on the order of fifteen to eighteen centimeters (15–18 cm). Thus, such a motor placed in, on top of or under the carrier arm does not interfere with the lateral positioning of the arm along the winding drum (6).

While one embodiment of our invention has been shown and described in detail herein, various changes may be made without departing from the scope of the present invention.

We claim:

1. In a device for reeling a plurality of adjacent webs of paper into separate rolls, wherein laterally-separated carrier arms having longitudinal axes and cross-sectional dimensions at right angles to the longitudinal axes are provided for supporting the rolls being wound in reeling axes, the carrier arms including heads for securing the rolls to be wound, the heads each being individually driven by an electric motor associated with the head, the improvement comprising; the electric motor being a direct current, permanent magnet motor of high power output, and the electric motor having a longitudinal axis disposed parallel to the longitudinal axis of its associated carrier arm and perpendicular to the reeling axis of a roll secured by the head of its associated carrier arm; and said motor having a maximum width taken as a cross-sectional dimension at right angles to the motor longitudinal axis, said motor maximum width being not greater than the cross-sectional dimension of the carrier arm, said motor being disposed in the carrier arm, with a single housing being provided for the carrier arm and motor.

2. The improvement defined in claim 1 in which said motor contains permanent magnets made of rare earth metals.

3. The improvement defined in claim 2 in which said permanent magnets are made of samarium cobaltate ($SmCo_5$).

4. In a device for reeling paper into rolls, the device having laterally separated carrier arms having a longitudinal axis, said carrier arms each being pivotally mounted at one end and each bearing clamping heads at the opposite end for securing a roll to be reeled along a reeling axis, which heads are individually driven by an electric motor associated with each carrier arm concerned, the improvement comprising; said motor being a direct-current permanent magnet motor of high power output, said motor having a longitudinal axis parallel to the longitudinal axis of the carrier arm on which it operates and perpendicular to the reeling axis of a roll secured by the head of the carrier arm, said motor being disposed in said carrier arm, with a portion of said carrier arm being a housing for said motor.

5. The improved device according to claim 4, wherein the motor contains permanent magnets made of samarium cobaltate ($SmCo_5$).

6. The improved device according to claim 4 wherein the electric motor has an external, cross-sectional dimension of between one-hundred fifty and one-hundred eighty millimeters (150–180 mm).

7. The improved device according to claim 4 wherein the electric motor develops a torque of two hundred to two-hundred twenty Newton/meters (200–220 Nm) at two thousand revolutions per minute (2000 rpm)

8. The improved device according to claim 4 wherein permanent magnets of said motor are made of rare earth metals.

* * * * *